US009510081B2

(12) United States Patent
Jiang

(10) Patent No.: US 9,510,081 B2
(45) Date of Patent: Nov. 29, 2016

(54) LIGHTING EARPHONE

(71) Applicant: Yongjiang Yin, Guangdong (CN)

(72) Inventor: Jing Jiang, Hubei (CN)

(73) Assignee: SHENZHEN ZHUIGUANG ELECTRONIC TECHNOLOGY CO., LTD (CN)

( * ) Notice: Subject to any disclaimer, the term of this patent is extended or adjusted under 35 U.S.C. 154(b) by 61 days.

(21) Appl. No.: 14/394,595

(22) PCT Filed: Apr. 11, 2013

(86) PCT No.: PCT/CN2013/074094

§ 371 (c)(1),
(2) Date: Oct. 15, 2014

(87) PCT Pub. No.: WO2013/159650

PCT Pub. Date: Oct. 31, 2013

(65) Prior Publication Data

US 2015/0092955 A1 Apr. 2, 2015

(30) Foreign Application Priority Data

Apr. 27, 2012 (CN) ..... 2012 2 0188066 U

(51) Int. Cl.

*H04R 1/10* (2006.01)
*H04R 1/06* (2006.01)
*H04R 1/02* (2006.01)

(52) U.S. Cl.

CPC ..... *H04R 1/1091* (2013.01); *H04R 1/028* (2013.01); *H04R 1/06* (2013.01); *H04R 1/10* (2013.01)

(58) Field of Classification Search

CPC ..... H04R 1/028; H04R 1/10; H04R 1/1016; H04R 1/1033; H04R 1/1041; H04R 2420/09; H04R 29/008; H04R 5/033; C09K 11/7774; F21S 10/00; F21S 4/003; G08B 1/08; H05B 33/00

USPC ..... 381/384, 74, 370, 77; 340/815.46; 362/84, 217.01, 86, 88; 313/358, 509, 313/511; 428/917; 315/169.3; 427/66

See application file for complete search history.

(56) References Cited

U.S. PATENT DOCUMENTS 5,917,288 A * 6/1999 Feldman ..... G08B 1/08 315/169.3

(Continued)

FOREIGN PATENT DOCUMENTS

| | | |
|---|---|---|
| CN | 201022227 Y | 2/2008 |
| CN | 101453601 A | 6/2009 |
| CN | 202679575 U | 1/2013 |

OTHER PUBLICATIONS

International Search Report for PCT Application No. PCT/CN2012/074094; International Filing Date: Apr. 11, 2013; 2 pgs.

*Primary Examiner* — Paul S Kim
*Assistant Examiner* — Norman Yu
(74) *Attorney, Agent, or Firm* — Schmeiser, Olsen & Watts, LLP

(57) ABSTRACT

A lighting earphone, comprising an earphone plug, a playback module and an earphone control board, wherein the earphone plug and the playback module are connected with the earphone control board through an earphone cord respectively is provided. The lighting earphone further comprises a power module, a control module and a lighting cable, wherein the power module is connected with the control module and the lighting cable respectively so as to supply power to the control module and the lighting cable; the control module is connected with one or more of the earphone plug, the earphone cord, the playback module or the earphone control board; and the lighting cable is connected with the control module so as to flicker and light under the control of the control module.

9 Claims, 5 Drawing Sheets

(56) References Cited

U.S. PATENT DOCUMENTS

2004/0022053 A1* 2/2004 Sharon ..... H05B 33/00
362/84

2005/0245191 A1* 11/2005 Falcon ..... G11B 23/049
455/3.06

2007/0081690 A1* 4/2007 Stagni ..... H04R 1/028
381/384

* cited by examiner

LIGHTING EARPHONE

CROSS-REFERENCE TO RELATED APPLICATIONS

This application claims priority to PCT Application No. PCT/CN2013/074094, having a filing date of Apr. 11, 2013, based off of CN 201220188066.4 having a filing date of Apr. 27, 2012, the entire contents of which are hereby incorporated by reference

FIELD OF TECHNOLOGY

The following relates to an earphone of a mobile device, and more particularly, relates to a lighting earphone.

BACKGROUND

With the development of science and technology, various mobile music devices such as Walkmans, MP3, CD or music phones successively emerge and are very popular with consumers, particularly young consumers. An earphone for enjoying music or calling is one of indispensable electronic accessories of these electronic devices, and is an important factor for a customer to select an electronic device.

Most of the existing earphones do not have a lighting function, and the disclosed lighting earphones have the defect of complex structure, so that lighting earphones are difficult to produce and apply in a large number, and the existing earphones are very stuffy and are not fashionable enough.

SUMMARY

The present invention provides a lighting earphone with a simple structure. The lighting earphone may flicker and light with the rhythm of music or call sound.

To achieve the above-mentioned, the present invention adopts the following technical solution.

A lighting earphone, comprising an earphone plug, a playback module and an earphone control board, the earphone plug and the playback module are connected with the earphone control board through an earphone cord respectively, and it further comprises a power module, a control module and a lighting cable, wherein the power module is connected with the control module so as to supply power to the control module and the lighting cable; the control module is connected with one or more of the earphone plug, the earphone cord, the playback module or the earphone control board; and the lighting cable is connected with the control module so as to flicker and light under the control of the control module. The playback module is applied for playing back sound, e.g. may be an earplug or an earmuff or other devices.

The control module is arranged on the earphone control board and comprises a sampling circuit and a control circuit, wherein the sampling circuit is connected with one or more of the earphone plug, the earphone cord, the playback module or the earphone control board so as to acquire audio signals and transmit the audio signals to the control circuit; and the control circuit is connected with the sampling circuit and the lighting cable respectively so as to control the lighting cable to flicker and light according to the audio signals.

The power module comprises a USB plug, which is connected with the earphone control board.

The lighting earphone further comprises a cassette for accommodating the earphone control board, and the USB plug is fixed at the front end of the earphone control board and extends out from the front end of the cassette; and the lighting cable and the earphone cord are connected with the earphone control board and extend out from the rear end of the cassette.

The lighting earphone further comprises a microphone plug, which is connected with the earphone control board.

Preferably, the power module comprises a battery and a battery circuit, wherein the battery is arranged in the battery circuit and connected with the earphone control board.

In the above-mentioned preferred embodiments, the battery is a rechargeable battery, the battery circuit further comprises a charging circuit connected with the battery, and the charging circuit is applied for charging the rechargeable battery.

Further, the earphone is provided with two playback modules, the earphone control board is arranged in a speaker box of one of the playback modules, and the power module is arranged in a speaker box of the other playback module.

As a more preferred embodiment, the earphone is provided with two playback modules connected through an arch board, and the earphone control board and the power module are arranged in the arch board.

In each preferred embodiment, the earphone cord and the lighting cable are wrapped together through a transparent or euphotic wrapping layer, and the cross section of the earphone cord and the lighting cable after wrapping is elliptical, flat or round. The earphone cord is placed in parallel to the lighting cable or the lighting cable is spirally wound outside the earphone cord. The lighting earphone disclosed has the advantages that the lighting brightness can be correspondingly changed based on the sound level and rhythm speed of music or call sound, and particularly, the lighting brightness of the lighting cable correspondingly flickers according to changes of music beats and tones. More importantly, the lighting earphone can directly obtain power from a computer or other electronic device connected with the lighting earphone through the USB plug, so that the trouble of replacing a battery or charging is avoided; and the USB plug and the earphone control board are arranged in the cassette, so that the lighting earphone is more compact and attractive.

The lighting earphone is particularly suitable for calling with computers, listening to music and listening to music in various fixed or mobile audio devices, and is a dynamic and fashionable new product.

In order to fully understand the objects, features and effects of the present invention, the conception, specific structure and generated technical effects of the present invention will be further described below in conjunction with accompanying drawings.

BRIEF DESCRIPTION

Figure 1:
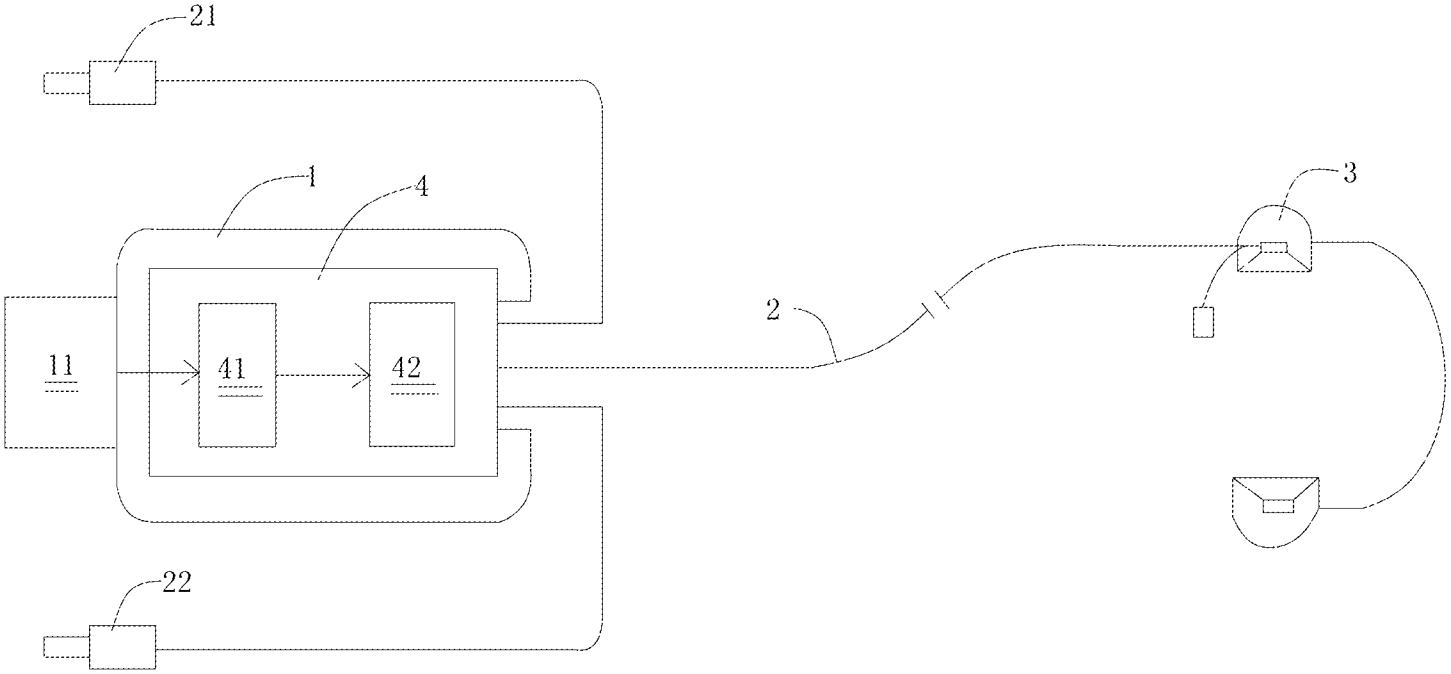
FIG. 1 is a structural schematic diagram of embodiment 1.

1-cassette; 11-USB plug; 12-battery; 2-cable; 21-earphone plug; 22-microphone plug; 23-earphone cord; 24-lighting cable; 25-wrapping layer; 3-playback module; 31-arch board; 4-earphone control board; 41-sampling circuit; 42-control circuit.

DETAILED DESCRIPTION

Embodiment 1

As shown in FIG. 1 to FIG. 4, a lighting earphone comprises an earphone plug 21, a playback module 3 and an earphone control board 4, wherein the earphone plug 21 and the playback module 3 are electrically connected with the earphone control board 4 respectively to complete a sound listening function of the earphone. In this embodiment, the playback module 3 is a pair of earplugs. In order to achieve the function that the lighting earphone can light and flicker with the rhythm of music or call sound, the lighting earphone further comprises a power module, a control module and a lighting cable 24, wherein the power module is applied for supplying power to the control module and the lighting cable 24; and the control module is applied for controlling the lighting cable 24 to flicker and light with the rhythm of music or call sound.

The control module is arranged on the earphone control board 4, and mainly comprises a sampling circuit 41 and a control circuit 42. The sampling circuit 41 is connected with one or more of the earphone plug 21, an earphone cord 23, the playback module 3 or the earphone control board 4 so as to receive and sample audio signals of the earphone. The sampling circuit 41 is connected with the control circuit 42 so as to transmit the sampled signals to the control circuit 42. The control circuit 42 is connected with the lighting cable 24 so as to control the lighting cable 24 to flicker and light by controlling the magnitudes of the output current and voltage according to the sampled signal. Therefore, the control circuit 42 may correspondingly change the magnitudes of the output current and voltage through sampling of the sampling circuit 41 according to the sound level and rhythm speed of music or call sound and the change of tones, so that the lighting cable 24 can correspondingly flicker with changes of music beats and tones.

Please refer to FIG. 1, which shows a structural schematic diagram of this embodiment. In this embodiment, the power module comprises a USB plug 11, which is fixedly connected with the earphone control board 4. The USB plug 11 is plugged into a USB interface of a computer or connected device, and receives power from the computer or connected device, so that the trouble of replacing a battery which is adopted to supply power is avoided; and the earphone is more attractive and elegant by adopting the USB plug 11 as a power supply. In this embodiment, the lighting earphone further comprises a cassette 1 for accommodating the earphone control board 4, the USB plug 11 extends out from the front end of the cassette 1, and the lighting cable 24 and the earphone cord 23 are connected with the earphone control board 4 from the rear end of the cassette 1.

In this embodiment, in order to apply the earphone to a mobile phone for calling, the lighting earphone further comprises a microphone plug 22, which extends into the cassette 1 from the rear end of the cassette 1 and is connected with the earphone control board 4. A microphone corresponding to the microphone plug 22 is also arranged close to the playback module 3, and may be conveniently used in a call.

The lighting cable 24 is an EL lighting cable, and is formed by spirally twisting at least three EL lighting lines to sequentially light part by part. Each of the EL lighting line of the lighting cable which can sequentially light part by part may light synchronously, or light sequentially according to a certain frequency cycle. The earphone cord 23 is a four-core shielded conductor, wherein each core is formed by twisting a plurality of insulated conductors. The earphone cord 23 and the lighting cable 24 may be placed in parallel to each other or the lighting cable 24 is spirally wound outside the earphone cord 23 in the following structural form.

Figure 2:
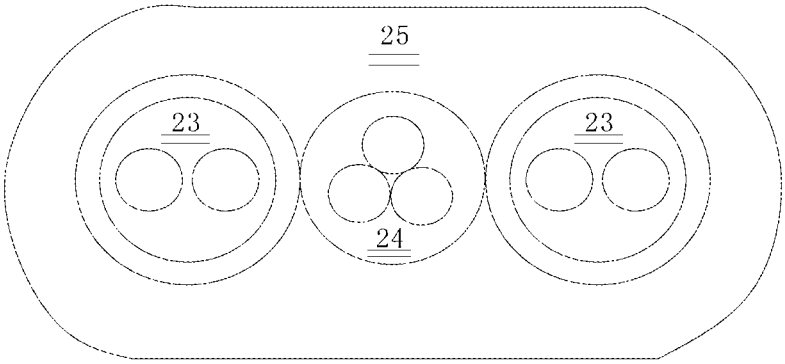
FIG. 2 is a cross section structure I of the earphone cord and the lighting cable.

Please refer to FIG. 2, the four-core shielded conductor of the earphone cord 23 is divided into two groups of two-core shielded conductors which are arranged in parallel on two sides of the lighting cable 24 respectively, and the outer layer of the earphone cord 23 and the lighting cable 24 is wrapped by a transparent or euphotic wrapping layer 25 to form a whole cable 2.

Figure 3:
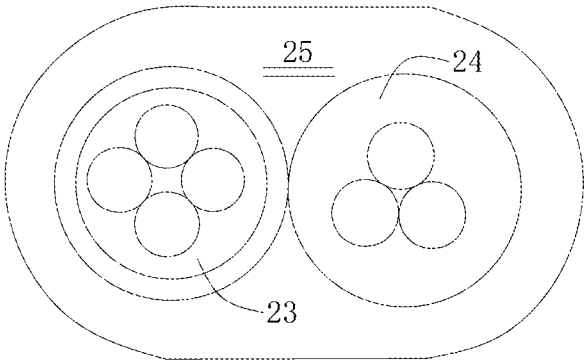
FIG. 3 is a cross section structure II of the earphone cord and the lighting cable.

Please refer to FIG. 3, the four-core shielded conductor of the earphone cord 23 is directly used as a group, the lighting cable 24 is used as a group and placed in parallel on one side of the earphone cord 23, and the earphone cord 23 and the lighting cable 24 are wrapped together by a transparent or euphotic wrapping layer 25 on the outer layer to form a whole cable 2.

Figure 4:
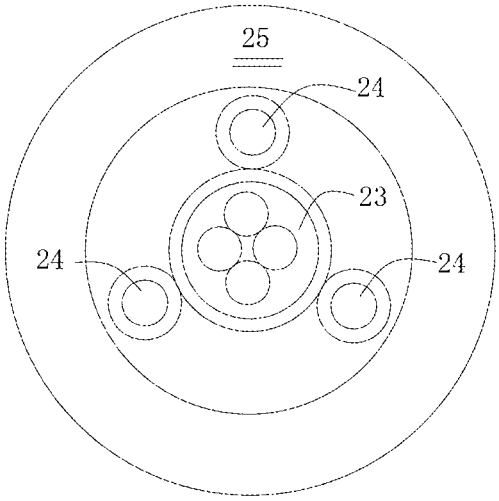
FIG. 4 is a cross section structure III of the earphone cord and the lighting cable.

Please refer to FIG. 4, the four-core shielded conductor of the earphone cord 23 is directly used as a group, the lighting cable 24 is spirally wound outside the earphone cord 23, and the earphone cord 23 and the lighting cable 24 are wrapped together by a transparent or euphotic wrapping layer 25 on the outer layer to form a whole cable 2.

It should be noted that no matter in which structural form the earphone cord 23 and the lighting cable 24 are, the cross section of the cable 2 may be elliptical, flat or round.

When the lighting earphone is used, the USB plug 11, the earphone plug 21 and the microphone plug 22 are plugged into a USB interface, an audio interface and a microphone jack of a computer or an audio device respectively, and the earphone plug 21 or the microphone plug 22 transmits audio signals to the sampling circuit 41 through the earphone control board 4. The sampling circuit 41 samples the audio signals and then transmits the audio signals to the control circuit 42, and the control circuit 42 controls the output current and voltage according to the signals of the sampling circuit 41 so as to control the change of brightness of the lighting cable 24 of the lighting earphone. At the moment, the lighting cable 24 of the lighting earphone correspondingly changes the lighting brightness along with the sound level of a call or music and the change of tones, and particularly when the music is listened, the light brightness of the lighting cable of the lighting earphone also correspondingly flickers with changes of music beats and tones.

Embodiment 2

The difference between this embodiment and embodiment 1 lies in that the power module of embodiment 1 adopts a battery 12, particularly a rechargeable battery for supplying power.

Figure 5:
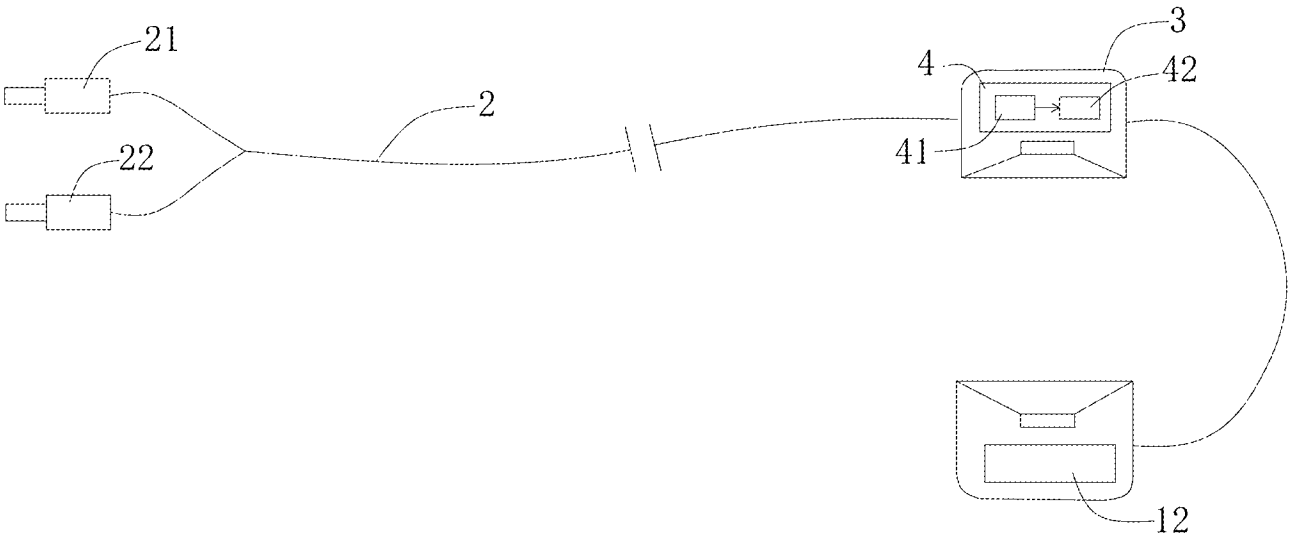
FIG. 5 is a structural schematic diagram of embodiment 2.
Figure 6:
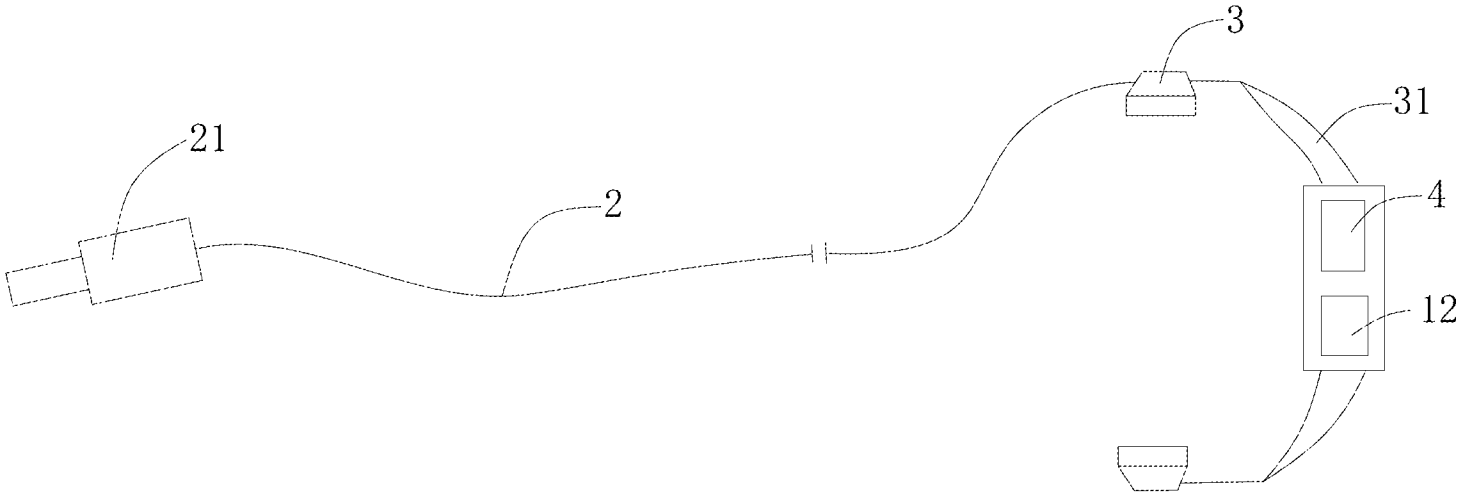
FIG. 6 is a structural schematic diagram of embodiment 3.

Refer to FIG. 5, which shows a structural schematic diagram of embodiment 2. The power module comprises a battery 12 and a battery circuit, wherein the battery 12 is arranged in the battery circuit and supplies power to the control module and the lighting cable 24. Preferably, the battery 12 is a rechargeable battery, and the battery circuit further comprises a charging circuit, so that the lighting earphone can be used conveniently.

In this embodiment, the sampling circuit 41 and the control circuit 42 of the control module are arranged on the earphone control board 4, which is arranged in a speaker box of one playback module 3, and the power module including the battery 12 and the battery circuit is arranged in a speaker box of the other playback module 3. It should be noted that the battery circuit of the power module may also be placed on the earphone control board 4. In order to prevent electromagnetic interference, shield protection is adopted for the earphone control board. The difference between embodiment 3 and embodiment 2 lies in that the two playback modules 3 in this embodiment are connected with each other through an arch board 31, and the power module and the earphone control board 4 are arranged in the arch board 31. In this embodiment, the playback modules 3 are a pair of earmuffs. It should be noted that the battery circuit of the power module may also be placed on the earphone control board 4. In order to prevent electromagnetic interference, shield protection is adopted for the earphone control board 4.

Embodiment 3

The difference between embodiment 3 and embodiment 2 lies in that the two playback modules 3 in this embodiment are connected with each other through an arch board 31, and the power module and the earphone control board 4 are arranged in the arch board 31. In this embodiment, the playback modules 3 are a pair of earmuffs. It should be noted that the battery circuit of the power module may also be placed on the earphone control board 4. In order to prevent electromagnetic interference, shield protection is adopted for the earphone control board 4.

Compared with the prior art, the lighting earphone of the present invention has the advantages that the lighting brightness may be correspondingly changed based on the sound level and rhythm speed of music or call sound, and particularly, the lighting brightness of the lighting cable correspondingly flickers according to changes of music beats and tones.

The lighting earphone is particularly suitable for calling with computers, listening to music and listening to music in various fixed or mobile audio devices, and is a dynamic and fashionable new product.

Preferred specific embodiments of the present invention are described in detail above. It should be understood that many modifications and variations could be made based on the conception of the present invention by those of ordinary skill in the art without any creative effort. Therefore, all technical solutions, obtained by those skilled in the art according to the conception of the present invention based on the prior art through logical analysis and reasoning or limited experiments, should be within the protection scope defined by the claims.

What is claimed is:

1. A lighting earphone, comprising an earphone plug, a playback module and an earphone control board, the earphone plug and the playback module being connected with the earphone control board through an earphone cord respectively, wherein the lighting earphone further comprises a power module, a control module and a lighting cable, wherein the power module is connected with the control module so as to supply power to the control module and the lighting cable; the control module is connected with one or more of the earphone plug, the earphone cord, the playback module or the earphone control board; the earphone cord is a four-core shielded conductor, wherein each core is formed by twisting a plurality of insulated conductors; and the lighting cable is formed by spirally twisting at least three Electroluminescent lighting lines, each of which may sequentially light part by part, and the lighting cable is connected with the control module so as to sequentially light part by part under the control of the control module;

wherein the control module is arranged on the earphone control board and comprises a sampling circuit and a control circuit, the sampling circuit is connected with one or more of the earphone plug, the earphone cord, the playback module or the earphone control board so as to acquire audio signals and transmit the audio signals to the control circuit; and the control circuit is connected with the sampling circuit and the lighting cable respectively so as to control the lighting cable to flicker and light according to the audio signals.

2. The lighting earphone of claim 1, wherein the power module comprises a USB plug, which is connected with the earphone control board.

3. The lighting earphone of claim 2, wherein it further comprising a cassette for accommodating the earphone control board, and the USB plug is fixed at the front end of the earphone control board and extends out from the front end of the cassette; and the lighting cable and the earphone cord are connected with the earphone control board and extend out from the rear end of the cassette.

4. The lighting earphone of claim 1, wherein the power module comprises a battery and a battery circuit, and the battery is arranged in the battery circuit and connected with the earphone control board.

5. The lighting earphone of claim 4, wherein the battery is a rechargeable battery, the battery circuit further comprises a charging circuit connected with the battery, and the charging circuit is applied for charging the rechargeable battery.

6. The lighting earphone of claim 5, wherein the earphone is provided with two playback modules, the earphone control board is arranged in a speaker box of one of the playback modules, and the power module is arranged in a speaker box of the other playback module.

7. The lighting earphone of claim 4, wherein the earphone is provided with two playback modules connected through an arch board, and the earphone control board and the power module are arranged in the arch board.

8. The lighting earphone of claim 1, wherein the earphone cord and the lighting cable are wrapped together through a transparent or euphotic wrapping layer, and the cross section of the earphone cord and the lighting cable after wrapping is elliptical, flat or round.

9. The lighting earphone of claim 8, wherein the earphone cord is placed in parallel to the lighting cable or the lighting cable is spirally wound outside the earphone cord.

* * * * *